US011491613B2

(12) United States Patent
He

(10) Patent No.: US 11,491,613 B2
(45) Date of Patent: Nov. 8, 2022

(54) HIGH-TORQUE RATCHET WRENCH

(71) Applicant: Huazhong He, Foshan (CN)

(72) Inventor: Huazhong He, Foshan (CN)

(73) Assignee: HUAZHONG HE, Foshan (CN)

( * ) Notice: Subject to any disclaimer, the term of this patent is extended or adjusted under 35 U.S.C. 154(b) by 137 days.

(21) Appl. No.: 16/611,779

(22) PCT Filed: Feb. 9, 2018

(86) PCT No.: PCT/CN2018/075941
§ 371 (c)(1),
(2) Date: Nov. 7, 2019

(87) PCT Pub. No.: WO2019/153227
PCT Pub. Date: Aug. 15, 2019

(65) Prior Publication Data
US 2020/0094383 A1 Mar. 26, 2020

(51) Int. Cl.
*B25B 13/46* (2006.01)

(52) U.S. Cl.
CPC ..... *B25B 13/463* (2013.01)

(58) Field of Classification Search
CPC ..... B25B 13/461; B25B 13/462
USPC ..... 81/476, 59.1, 60, 61, 62, 63, 63.1
See application file for complete search history.

(56) References Cited

U.S. PATENT DOCUMENTS 2,028,876 A * 1/1936 Lotts ..... F16D 41/07 192/43
3,527,327 A * 9/1970 McCreary ..... B25B 21/004 192/46
4,297,924 A * 11/1981 Stephens ..... B25B 13/462 192/44
6,112,624 A 9/2000 Chen
6,253,646 B1 * 7/2001 Chang ..... B25B 13/462 192/44
8,347,760 B2 * 1/2013 Yu ..... B25B 15/04 81/119
2006/0288822 A1 * 12/2006 Langas ..... B25B 13/08 81/59.1

(Continued)

FOREIGN PATENT DOCUMENTS

CN 104149059 A 11/2014
CN 106624609 A 5/2017

(Continued)

*Primary Examiner* — Monica S Carter
*Assistant Examiner* — Alberto Saenz
(74) *Attorney, Agent, or Firm* — Dragon Sun Law Firm, PC; Jinggao Li, Esq.; Nathaniel Perkins

(57) ABSTRACT

A high-torque ratchet wrench including a wrench body having a driving aperture and a handle, and a drive member is disposed in the driving aperture and an axial position-limiting mechanism is disposed between the driving aperture and the drive member to limit the relative axial displacement. The external side wall of the drive member and the internal aperture side of the driving aperture form two cylindrical drive faces nested, wherein a first cylindrical drive face is provided with a pin recess, a pin is rotatably mounted in the pin recess, a relief is disposed on the side face of pin, the pin is connected with a resilient reset member, the pin is rotated with the resilience of a resilient reset member, and a relief is driven to stand out of the pin recess and contacts a second drive face.

9 Claims, 10 Drawing Sheets

(56) References Cited

U.S. PATENT DOCUMENTS

2016/0129562 A1* 5/2016 Douglass ..... B25B 13/462
81/59.1

FOREIGN PATENT DOCUMENTS

CN 108058121 A 5/2017
CN 107344343 A 11/2017

* cited by examiner

Tension Direction of Spring Ring

Tension Direction of Spring Ring

HIGH-TORQUE RATCHET WRENCH

FIELD OF THE INVENTION

The present invention relates to a tool for tightening and disassembly, and more particularly to a ratchet wrench.

BACKGROUND OF THE INVENTION

A ratchet wrench is a hand tool for tightening and loosening bolts. This wrench can tighten and loosen screws or nuts by swinging at a certain angle. Two stay bars are disposed in the wrench head on the left and right sides. One or more stay teeth are arranged on the stay bars, and when screws or nuts are tightened, the teeth will be firmly pressed against the ratchet teeth. When a handle is turned in an opposite direction, stay bars will be released from the sloping surface of ratchet teeth, so that screws or nuts will not be reversed with it. If screws or nuts are to be loosened, only the reversing part is need to be switched to another stay bar.

However, when a high torque is applied for turning the ratchet wrench, there will be excess stress on ratchet teeth if only a limited number of stay teeth are pressed against one or more ratchet teeth, so that slippage is easily caused and even stay teeth or ratchet teeth are damaged.

Generally, the quality of steel used for wrench ratchets and stay teeth is improved, the thickness of wrench housing is increased, the size of ratchets is enlarged and the number of stay teeth is increased in the prior art to solve this problem. But it causes a great increase in the wrench cost; in addition, the wrench becomes heavier.

BRIEF DESCRIPTION OF THE INVENTION

The object of the present invention is to provide a high-torque ratchet wrench.

The wrench in the present invention consists of a wrench body having a driving aperture and a handle, and a drive member is disposed in the driving aperture and an axial position-limiting mechanism is disposed between the driving aperture and the drive member to limit the relative axial displacement, and the key is that the external side wall of the drive member and the internal aperture side of the driving aperture form two cylindrical drive faces nested, wherein a first drive face is provided with a pin recess, a pin is rotatably mounted in the pin recess, a relief is disposed on the side face of pin, the pin is connected with a resilient reset member, the pin is rotated with the resilience of a resilient reset member, a relief is driven to stand out of the pin recess and contacts a second drive face, and the distance between the outermost end point of the relief and the central axis of the pin is greater than the minimum distance between the second drive face and the central axis of the pin.

The operating principle of the wrench is shown below:

A drive member is movably mounted in a driving aperture and an axial position-limiting mechanism is used to prevent a drive member from axially moving from a driving aperture and being released from a driving aperture. A drive member is used to fit a fastener to be tightened or loosened so as to transfer the rotational torque from a handle to a fastener. A resilient reset member is used to exert and keep a resilient force in a predetermined direction on the pin disposed in the pin recess on the first drive face; this resilient force can rotate the pin in the predetermined direction, and when the pin rotates, a relief rotates synchronously with the pin, so that the relief gradually stands out of the pin recess and contacts the second drive face; the distance between the outermost end point of the relief and the central axis of the pin is greater than the minimum distance between the second drive face and the central axis of the pin, so the relief cannot continue to rotate due to the blocking of the second drive face. In addition, the surface of parts and elements cannot be completely smooth, so a certain force of friction exists between the second drive face and the relief due to mutual contact.

In the working process, when the direction of rotation of a handle is the same as that of a pin with the action of a resilient reset member, the force of friction between the second drive face and the relief will push the relief in the original direction of rotation so as to produce an increasingly high pressure between the relief of pin and the second drive face and also cause an increasingly high force of friction between them, so that the pin can be progressively pressed against the side wall of the pin recess and the pin and the drive member can form a relatively stable structure under pressure; in this way, the force of friction can rotate the drive member via the pin so as to realize the torque transfer between the handle (via the driving aperture) and the drive member (and fasteners engaged with the drive member, e.g. nuts).

When the handle is rotated in the opposite direction, the force of friction between the second drive face and the relief can drive the pin to overcome the resilient force of the resilient reset member, and with the synchronous reverse rotation of the second drive face and the reverse rotation of the pin, the relief will gradually move in the direction of the pin recess to decrease the pressure between it and the second drive face, so that the force of friction between the relief and the second drive face is increasingly reduced, and finally, the relief slides over the second drive face, so that the drive member and the fastener engaged with the drive member will not reversely rotate with the handle. The handle reciprocates at an angle to drive the unidirectional rotation of the drive member by the engagement of the second drive face with the relief and complete the disassembly of fasteners.

Compared with the conventional wrenches with the ratchet meshing mode, the principle of torque transfer adopted by the wrench is entirely different, which relies on the pressing between the relief and the second drive face; in this way, the upper limit of torque to be withstood by the wrench is dependent on the overall strength of the pin and two drive faces, rather than the contact area and structural strength of rachet teeth, so the upper limit of torque transfer can be easily increased. When the wrench operates, all pin reliefs will contact the second drive face so that the torque can be evenly distributed on all reliefs, and the manufacturer may increase the quantity of pins as needed and even distribute pins evenly on the whole first drive face to obtain a greater limit of torque transfer.

And because the pin is disposed on the first drive face, its length can be equal to or slightly less than the width of the drive face and the whole side face of the relief can contact the second drive face to ensure sufficient force of friction between them, and the pressure between the relief and the second drive face is not concentrated on a point but distributed on the whole side face of the relief to lower the requirement for relief strength.

The resilient reset member can have a variety of structures; for example, a small spring is mounted in each pin recess, both ends of the spring are separately connected with the pin and the inside wall of the pin recess and the pin is rotated by using the spring force so as to realize the contact between the relief and the second drive face. However, the installation of the resilient reset member is relatively complicated and accounts for a larger space, so that the wrench structure cannot be small and compact. To solve this problem, the present invention provides the following scheme for a resilient reset member: the pin is disposed with a spring pressing portion, the resilient reset member is a spring ring and the spring ring is covered on or pressed against the spring pressing portion of all pins; the spring ring deviates from the central axis of the pin under the force applied to a pin by the spring pressing portion to rotate the pin under the spring force of the resilient reset member.

Spiral springs can be connected in an end-to-end manner to form a spring ring, such as ring-shaped springs, and an elastic rubber ring can also be directly adopted, provided that elastic rubber rings are provided with the elastic force of contraction or expansion. After the assembly of a drive member and pins is completed, the spring ring is covered or clamped on the spring pressing portion of all pins and the spring ring applies the elastic force to pins in the direction of or opposite to the center of spring ring, and the spring pressing portion resolves this elastic force to produce a force to rotate pins in the predetermined direction, so that the reliefs of pins contact the second drive face after the rotation of pins, ensuring that the drive member can rotate synchronously with the driving aperture in the forward direction with the engagement of the second drive face and reliefs; when the wrench hand is pulled in the opposite direction, the opposite force of friction of the second drive face pushes pins to rotate in the opposite direction, so as to rotate the relief in the direction of the pin recess, gradually reduce the area of contact with the second drive face and finally slide the relief over the second drive face to avoid the drive member and the fasteners engaged with the drive member from rotating with the driving aperture in the opposite direction. A single spring ring is adopted in the scheme to realize the resilient reset of all pins, so that the structure can be greatly simplified, the parts and elements of the wrench can be conveniently assembled and the space usage can be reduced to realize a small, compact and easy-to-operate wrench structure.

Further, to prevent axial play of the spring ring and even avoid the spring ring from being released from pins, the drive faces or the spring pressing portion of pins are provided with a fixed recess used for limiting the axial movement of spring ring, and the spring ring is mounted in the fixed recess to avoid axial movement.

Further, the pin side having the back toward the relief is an arc surface and the pin recess is provided with an arc structure adapting to the arc surface. Due to the engagement of the arc surface with the arc structure, the resistance encountered by pins during the process of rotation can be reduced.

Further, ratchet teeth are evenly distributed on the second drive face, the direction of extension of ratchet teeth is parallel to the central axis of the driving aperture, and the reliefs are the pin teeth mated to the ratchet teeth. The engagement principle of the ratchet teeth and the pin teeth is shown as follows: the resilient reset member is used to exert and keep the resilient force in the predetermined direction, and this resilient force rotates pins to engage the pin teeth with the ratchet teeth, so that the drive member can unidirectionally rotate in the driving aperture only; when the handle is rotated in the opposite direction, the guide slope of ratchet teeth applies a force to the pin teeth so that the pin teeth can overcome the spring force of the resilient reset member to remove the engagement with ratchet teeth and slide pin teeth over the back of ratchet teeth, so the drive member and the fasteners engaged with the drive member will not rotate with the handle in the opposite direction. The mode of engagement of ratchet teeth with pin teeth is adopted to lower the requirements for machining accuracy of the fit clearance between the reliefs and the second drive face and avoid the reliefs of some pins from being pressed against the second drive face due to insufficient accuracy of machining and further causing unevenly distributed stress between the drive member and the driving aperture.

Further, the first drive face is a rough surface which has been polished or knurled surface or striped surface, so a certain force of friction exists between the second drive face and the relief due to mutual contact.

Further, the axial position-limiting mechanism is a snap spring, the two drive faces are provided with a snap spring recess at the corresponding location, and the snap spring is mounted in the snap spring recess. The snap spring is used to limit the axial movement of the drive member in the driving aperture, having the advantages of small structure and easy mounting.

Further, a quincuncial through hole or a cylinder in the shape of a regular polyhedron standing out of the wrench surface is arranged in the center of the drive member. Both sides of the drive member having a quincuncial through hole can be engaged with fasteners, so only the wrench is flipped over to realize the reverse torque transfer of the drive member when a fastener is to be turned in the opposite direction. On the drive member, the cylinder in the shape of a regular polyhedron standing out of the wrench surface can be inserted and embedded in a sleeve and be engaged with the fastener by using the sleeve.

Further, the driving aperture comprises two ends separately arranged on the handle, having the mounting direction opposite to that of the drive member engaged with the two driving apertures and the pin, resilient reset member and axial position-limiting mechanism between them, and when a fastener is to be turned in the opposite direction, only the wrench is turned and another drive member is used to fit the fastener so as to realize the reverse torque transfer.

The wrench in the present invention has a novel and unique structure of torque transfer to greatly enhance the capability of torque transfer and simultaneously provide the whole wrench with a simple and compact structure, so that the wrench has very good utility and commercial competitiveness.

Symbols of accompanying drawings: 1. driving aperture; 11. inner hole wall; 12. ratchet tooth 2. handle 3. drive member; 31. through-hole; 32. pin recess; 33. fixed recess; 34. cylinder; 4. pin; 41. relief; 42. arc surface; 43. spring pressing portion; 44. bearing face; 5. spring ring; 6. snap spring; 7. snap spring recess.

DETAILED DESCRIPTION OF THE PREFERRED EMBODIMENTS

The preferred embodiments, such as the shape and structure of each element involved, relative location and connection relationship between various parts, functions and operating principles of various parts, are described in detail by reference to the accompany drawings and the description of embodiments.

Embodiment 1

Figure 1:
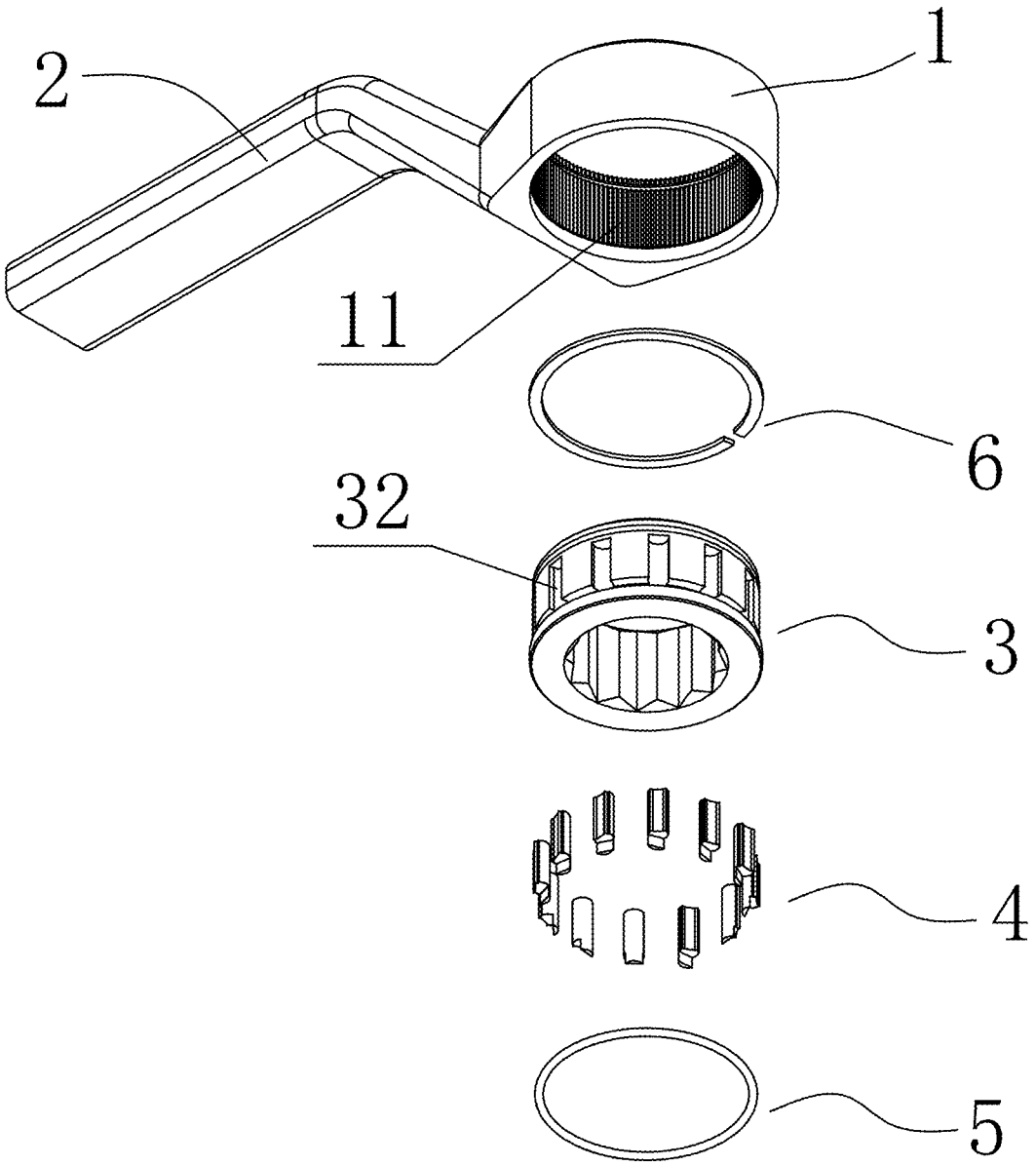
FIG. 1 is a schematic view of breakdown structure of the wrench in Embodiment 1.
Figure 4:
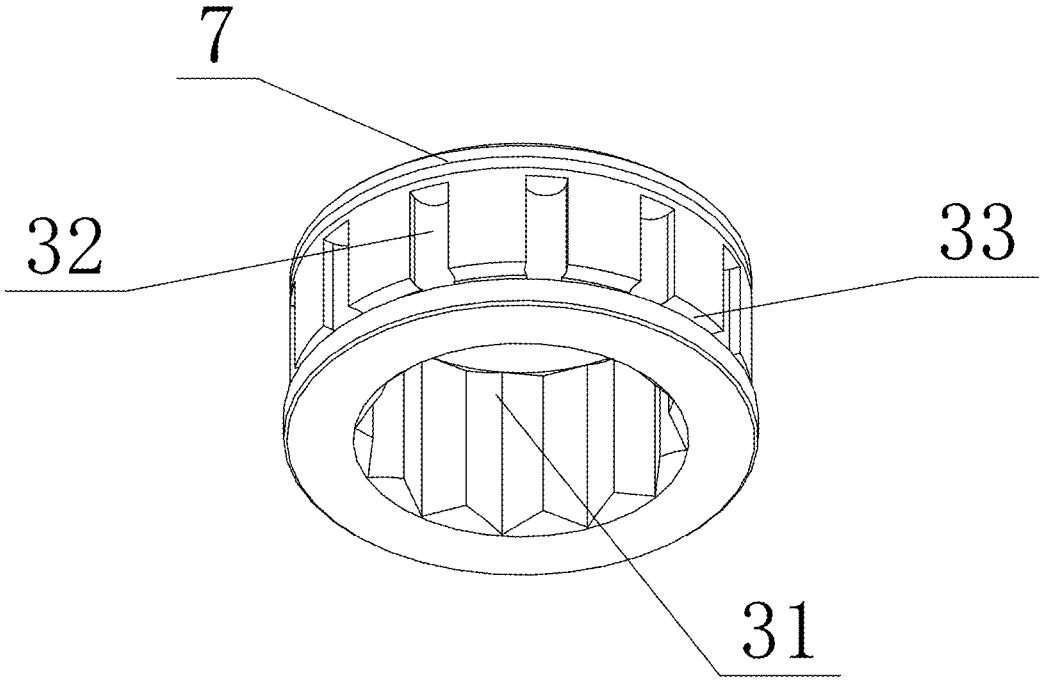
FIG. 4 is a schematic view of the structure of the drive member in Embodiment 1.
Figure 5:
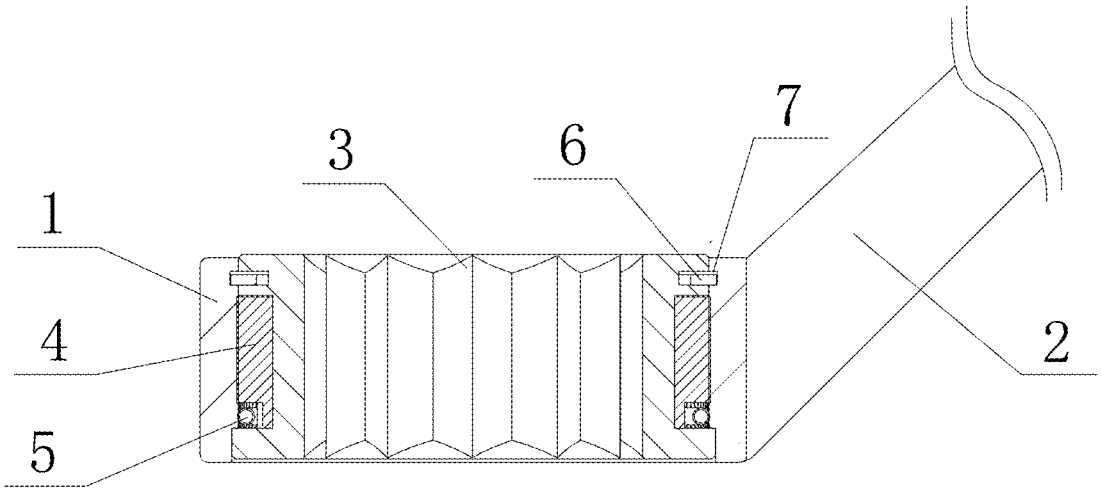
FIG. 5 is a schematic view (sectional view) of the engagement of the drive members, pins, driving apertures and spring rings in Embodiment 1.
Figure 6:
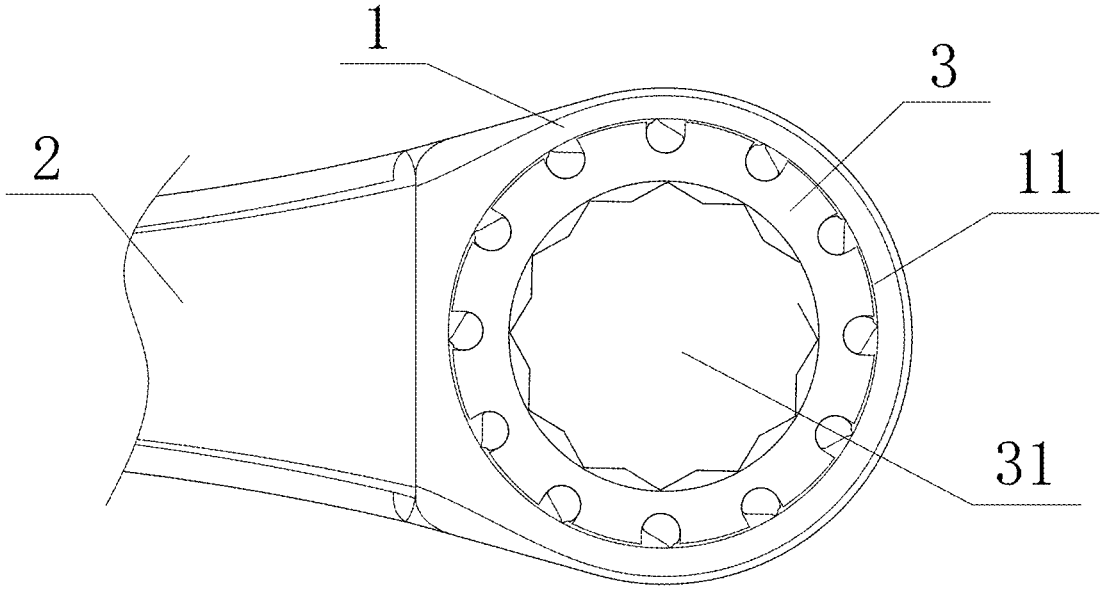
FIG. 6 is a schematic view of the engagement of the drive members, pins and driving apertures in Embodiment 1.

As illustrated in FIG. 1, the wrench in this embodiment comprises a wrench body having a driving aperture 1 and a handle 2, wherein the driving aperture 1 has the structure of a rounded through hole and has only one end disposed on the handle 2, a drive member 3 is arranged in the driving aperture 1 and an axial position-limiting mechanism is used to prevent the drive member 3 from axially moving from the driving aperture 1 and further being released from the driving aperture 1, and the axial position-limiting mechanism in this embodiment is realized by adopting the structure of a snap spring 6 mounted in a snap spring recess 7 as shown in FIGS. 4-5; As illustrated in FIG. 4, a through hole 31 having a quincuncial section is arranged in the center of a drive member 3 to fit a fastener, such as bolts, so as to transfer the rotational torque from the handle 2 to the fastener.

Figure 2:
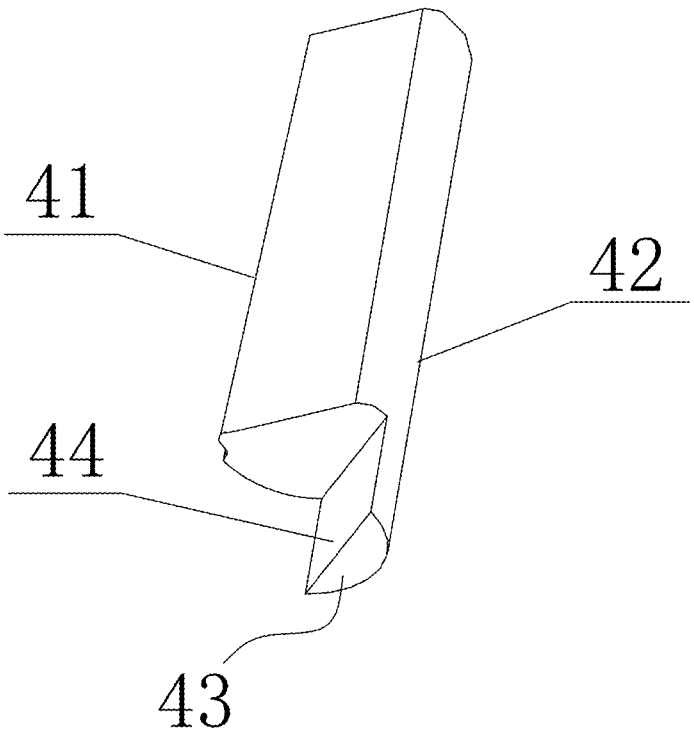
FIG. 2 is a schematic view of stereostructure of the pin in Embodiment 1.
Figure 3:
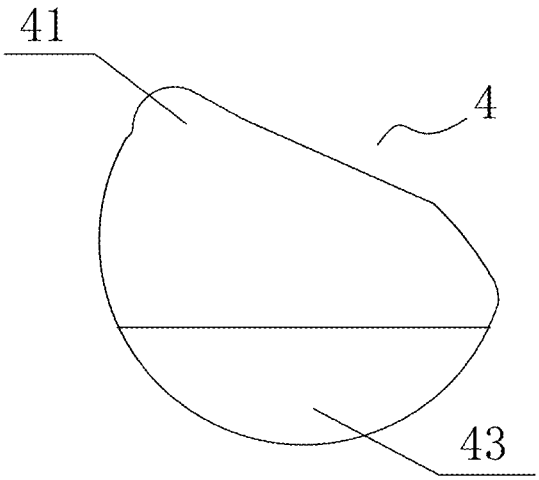
FIG. 3 is a bottom view of the pin in Embodiment 1.

As illustrated in FIGS. 1, 4, 5 and 6, the external side wall of the drive member 3 and the inner hole wall 11 of the driving aperture 1 form two cylindrical drive faces nested; in this embodiment, the external side wall of the drive member 3 is used as the first drive face, on which a plurality of pin recesses 32 that are parallel to the axial direction of the driving aperture 1 are evenly distributed, and in this embodiment, a total of 12 pin recesses 32 are arranged, and it is understood that this number can be increased or decreased as needed. The inner hole wall 11 of the driving aperture 1 is used as the second drive face; a pin 4 can be rotatably mounted in the pin recess 32 as shown in FIGS. 2 and 3, and the side face of the pin 4 is provided with a relief 41 at a ridge, the direction of extension of the relief 41 is parallel to the axial direction of the driving aperture 1, and the side face of the relief 41 facing the inner hole wall 11 of the driving aperture 1 is an arc surface; the pin 4 is connected with a resilient reset member, and in this embodiment, the resilient reset member is a spring ring 5, and the pin 4 rotates under the spring force of the resilient reset member to make the relief 41 stand out of the pin recess 32 and contact the inner hole wall 11 of the driving aperture 1; the distance between the outermost end point of the relief 41 and the central axis of the pin 4 is greater than that between the inner hole wall 11 of the driving aperture 1 and the central axis of the pin 4.

To increase the force of friction between the relief 41 and the inner hole wall 11 of the driving aperture 1, the surface of the relief 41 and/or the inner hole wall 11 of the driving aperture 1 can be rough surface which has been polished, or knurled surface or striped surface, etc., and the basic principles of torque transfer are the same, so analysis will not be made in detail.

The side of the pin 4 having the back toward the relief 41 is an arc surface 42 and the pin recess 32 is provided with an arc structure adapting to the arc surface 42, and the arc surface 42 fits the arc structure to reduce the resistance encountered by the pin 4 during the process of rotation and limit the rotation of the pin 4 properly.

As illustrated in FIGS. 2, 3, 7 and 8, a stepped spring pressing portion 43 is disposed on the end of the pin 4 and this spring pressing portion 43 is provided with a bearing face 44, and in this embodiment, the bearing face 44 is a plane that is parallel to the axial direction of the pin 4; the resilient reset member is a spring ring 5 that is arranged outside the circle surrounded by all pins 4, and the spring ring 5 is covered on the bearing face 44 of the spring pressing portion 43 of all pins 4 at the same time.

Figure 7:
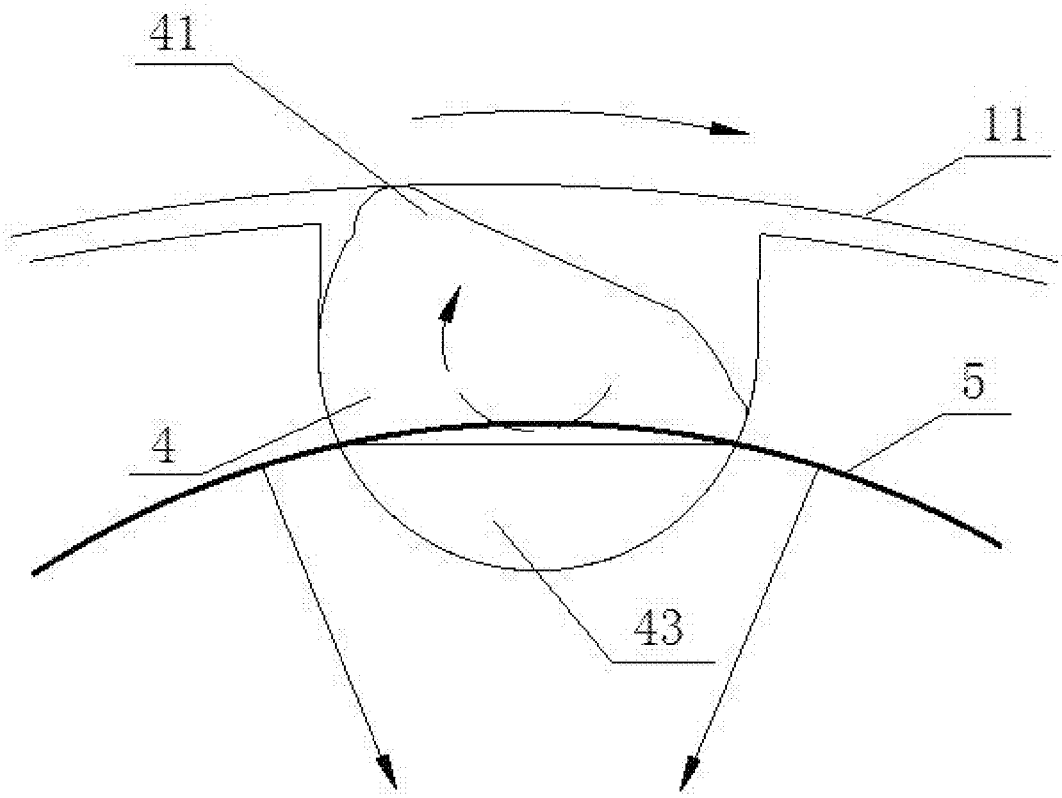
FIGS. 7 and 8 are schematic views of the engagement principle of the pins and driving apertures in Embodiment 1.

As illustrated in FIG. 7, the spring ring 5 contracts under the spring force, the spring ring 5 applies to the bearing face 44 of the pin 4 the elastic force which tends towards the center of the spring ring 5 (i.e. the central axis of the driving aperture 1), and under the decomposition of the bearing face 44, part of the elastic force is transformed to the force used for rotating the pin 4 clockwise (as shown in the dotted arrow in FIG. 7) so as to make the relief 41 of the pin 4 stand out of the pin recess 32 gradually and contact the inner hole wall 11 of the driving aperture 1; namely, the diameter of the element formed by the drive member 3 and the pins 4 is increasingly large to expand and finally the external side face of this element is tightly pressed against the inner hole wall of the driving aperture 1, which is similar to the locking of the drive shaft.

When the handle 2 rotates clockwise (as shown in the dotted arrow in FIG. 7), the force of friction between the inner hole wall 11 of the driving aperture 1 and the relief 41 will push the relief 41 in the original direction of rotation (i.e. in a clockwise direction, as shown in the dotted arrow in FIG. 7), so that the pressure between the relief 41 of the pin 4 and the inner hole wall 11 of the driving aperture 1 is increasingly high and the force of friction between then is also increasing to press the pin 4 against the side wall of the pin recess 32, and the pin 4 and the drive member form a relatively stable structure under pressure; in this way, the force of friction and the pressure push the drive member 3 to rotate by using the pin 4 to realize the torque transfer between the handle 2 (via the driving aperture 1) and the drive member 3 (and the fastener engaged with the drive member 3).

Figure 8:
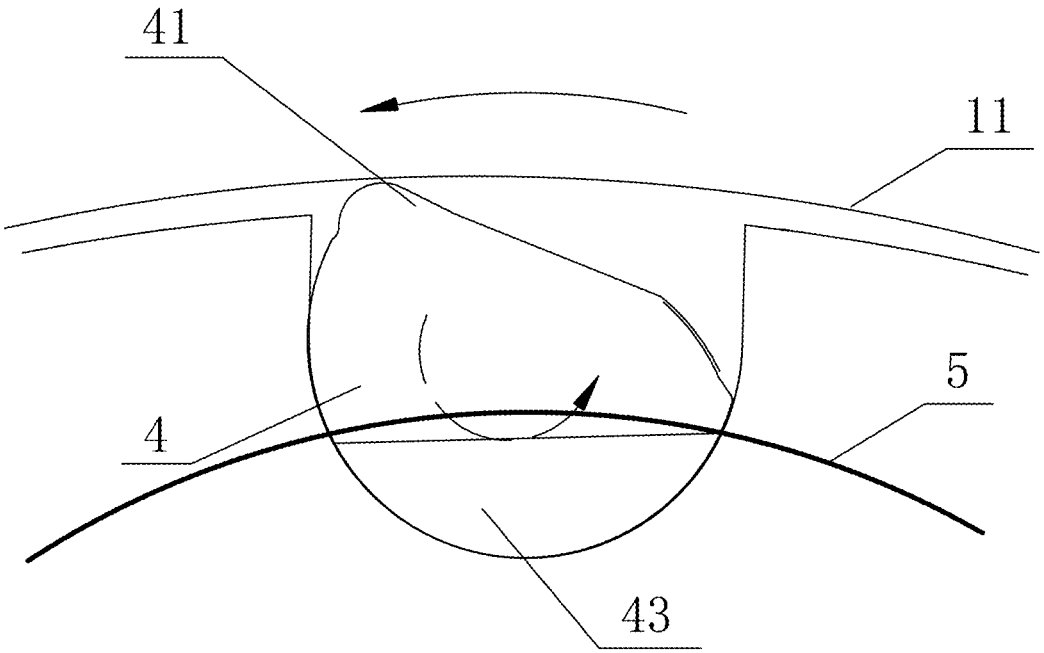
Figure 9:
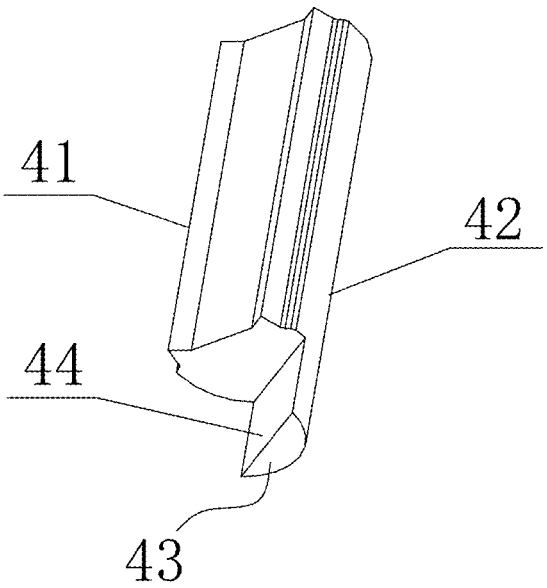
FIG. 9 is a schematic view of stereostructure of the pin in Embodiment 2.
Figure 10:
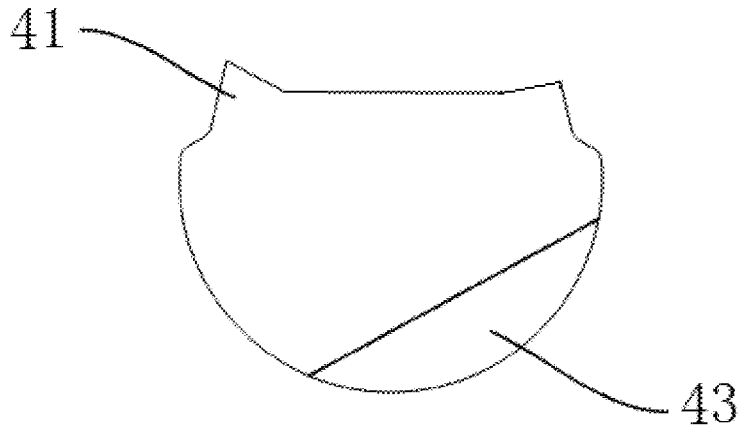
FIG. 10 is a bottom view of the pin in Embodiment 2.
Figure 11:
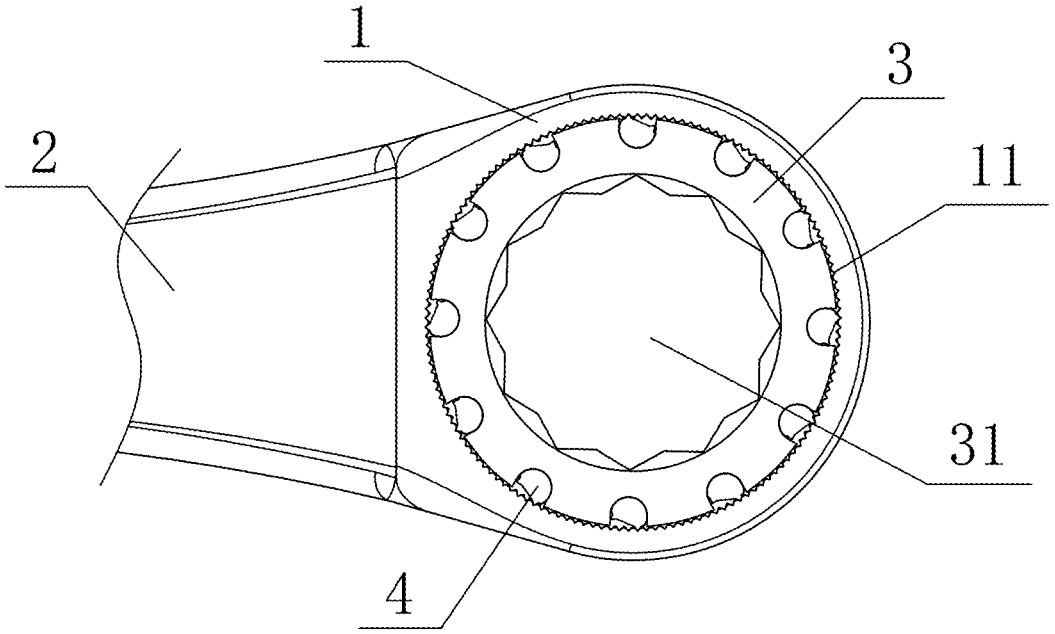
FIG. 11 is a schematic view of the engagement of the drive members, pins and driving apertures in Embodiment 2.

As illustrated in FIG. 8, when the handle 2 rotates in the opposite direction (i.e. it rotates anticlockwise) (as shown in the dotted arrow in FIG. 7), the force of friction between the inner hole wall 11 of the driving aperture 1 and the relief 41 will drive the pin 4 to overcome the elastic force of the spring ring 5 and to rotate synchronously with the inner hole wall 11 of the driving aperture 1 in the opposite direction (as shown in the dotted arrow in FIG. 8), so that the spring ring 5 can expand and gather the elastic potential energy under the force applied by the pin 4. Due to the reverse rotation of the pin 4, the relief 41 will gradually move in the direction of the pin recess 32 to increasingly reduce the pressure between it and the inner hole wall 11 of the driving aperture 1 and also increasingly decrease the force of friction between the relief 41 and the inner hole wall 11 of the driving aperture 1, and finally, the relief 41 slides over the inner hole wall 11 of the driving aperture 1, so that the drive member 3 and the fastener engaged with the drive member 3 will not rotate synchronously with the handle 2 in the opposite direction; namely, the diameter of the element formed by the drive member 3 and the pin 4 becomes smaller to contract, and finally the external side face of this element is not pressed against the inner wall hole of the driving aperture 1 to relieve blocking. The handle 2 reciprocates at an angle to drive the unidirectional rotation of the drive member 3 by the engagement of the inner hole wall 11 of the driving aperture 1 with the relief 41 and complete the disassembly of fasteners.

It is understood that the relief 41 can be arranged at another ridge of the pin 4 and the direction of the bearing face 44 can be changed so as to change the direction of rotation of the drive member 3 in the driving aperture 1, and the engagement principle of the relief 41 with the inner hole wall 11 of the driving aperture 1 and the spring ring 5 is the same as that described above, so it will not be repeated.

The limit of torque transfer of a conventional ratchet wrench is dependent on the strength of the engaging position of ratchet teeth, so in order to enhance the strength of the engaging position, the materials of ratchet teeth shall be improved (the costs shall be increased), or the engagement depth of the top of ratchet teeth shall be increased, but in this way, the idle stroke will be increased and the efficiency reduced when the wrench rotates in the opposite direction. In this embodiment, before the pin 4 is not mounted, the outer diameter of the drive member 3 is a and the inner diameter of the driving aperture 1 is a+b (a and b can be determined according to the specific machining requirements. b refers to the distance between the outermost end point of the pin relief and the first drive face after the pin is mounted), and in this case, the drive member 3 can flexibly rotate in the driving aperture 1; after the pin 4 and the spring ring 5 are disposed, one side of the relief 41 of the pin 4 will extend slightly upward to press against the inner hole wall 11 of the driving aperture 1 under the elastic force of the spring ring 5; namely, the motion distance of the relief 41 of the pin 4 is not more than b in the process of switching between normal rotation and reverse rotation of the wrench, so the pin 4 has an extremely small idle stroke when the wrench 2 stops rotating reversely and the reconnection and torque transfer between the drive member 3 and the driving aperture 1 can be realized after the wrench 2 stops rotating reversely, with the aim to improve the efficiency of the wrench.

The single spring ring 5 is adopted in the above scheme to realize the resilient reset of all pins 4 at the same time, so that the structure can be greatly simplified, the parts and elements of the wrench can be conveniently assembled and the space usage can be reduced to realize a small, compact and easy-to-operate wrench structure. It is understood that the bearing face 44 should be an arc surface having the center of a circle based on the central axis of the driving aperture 1 in order to enhance the fit of the spring ring 5 and the spring pressing portion 43, and after the relief 41 is fitted with the inner hole wall 11 of the driving aperture 1, the arc surface can be perfectly fitted with the spring ring 5 so as to ensure the stability of the location of the relief 41, but the difficulty in the machining of this arc surface is relatively high and the corresponding functions still can be completed by using the planar bearing face 44, and the manufacturer can select and set the bearing face 44 as the plane or arc surface as needed. Spiral springs can be connected in an end-to-end manner to form the spring ring 5 and an elastic rubber ring can also be directly adopted, provided that the spring ring 5 are provided with the elastic force of contraction, and the torque transfer is not dependent on the size of elastic force of the spring ring 5; therefore, the requirements for elastic force of the spring ring 5 are not high and a common ring-shaped spring can be used, which will not be repeated herein.

As illustrated in FIG. 4, in order to prevent axial play of the spring ring 5 and even avoid the spring ring from being released from the pin 4, the external side face of the drive member 3 is provided with a fixed recess 33 used for limiting the axial movement of the spring ring 5, wherein this fixed recess 33 is intersected with the pin recess 32 and the spring ring 5 is clamped in the fixed recess 33 to avoid axial movement, and meanwhile the resilient resetting function of the pin 4 will not be influenced.

In this embodiment, the axial position-limiting mechanism adopts a snap spring 6 that is frequently used, the two drive faces are provided with a snap spring recess 7 at the corresponding location, and the snap spring 6 is mounted in the snap spring recess. The snap spring 6 is used to limit the axial movement of the drive member 3 in the driving aperture 1, having the advantages of small structure and easy mounting.

Compared with the conventional wrenches with the ratchet meshing mode, the principle of torque transfer adopted by the wrench is entirely different, which relies on the pressing between the relief 41 and the inner hole wall 11 of the driving aperture 1; in this way, the upper limit of torque to be withstood by the wrench is dependent on the overall strength of the pin 4 and two drive faces, rather than the contact area and structural strength of rachet teeth, so the upper limit of torque transfer can be easily increased. When the wrench operates, the reliefs 41 of all pins 4 will contact the inner hole wall 11 of the driving aperture 1 so that the torque can be evenly distributed on all reliefs 41, and the manufacturer may increase the quantity of the pins 4 as needed and even arrange the pins 4 evenly on the external circumferential wall of the whole drive member 3 to obtain a greater limit of torque transfer.

And because the pin 4 is disposed on the external circumferential wall of the drive member 3, its length can be slightly less than the width of the external circumferential wall of the drive member 3 and the whole side face of the relief 41 can contact the inner hole wall 11 of the driving aperture 1 to ensure sufficient force of friction between them, and the pressure between the relief 41 and the inner hole wall 11 of the driving aperture 1 is not concentrated on a point but distributed on the whole side face of the relief 41 to lower the requirement for the strength of the relief 41.

In this embodiment, the driving aperture 1 is provided with a through-hole structure and both sides of the drive member 3 can be engaged with fasteners, so only the wrench is flipped over to realize the reverse torque transfer of the drive member 3 when a fastener is to be turned in the opposite direction.

Embodiment 2

As illustrated in FIGS. 9, 10, 11, 12 and 13, the difference from Embodiment 1 is that the ratchet teeth 12 are evenly arranged on the inner hole wall 11 of the driving aperture 1 in this embodiment, the extension direction of the ratchet teeth 12 is parallel to the central axis of the driving aperture 1 and both sides of the convex part are in the shape of tool edge so that convex part 41 can form a ratchet structure matching the ratchet teeth 12.

Figure 12:
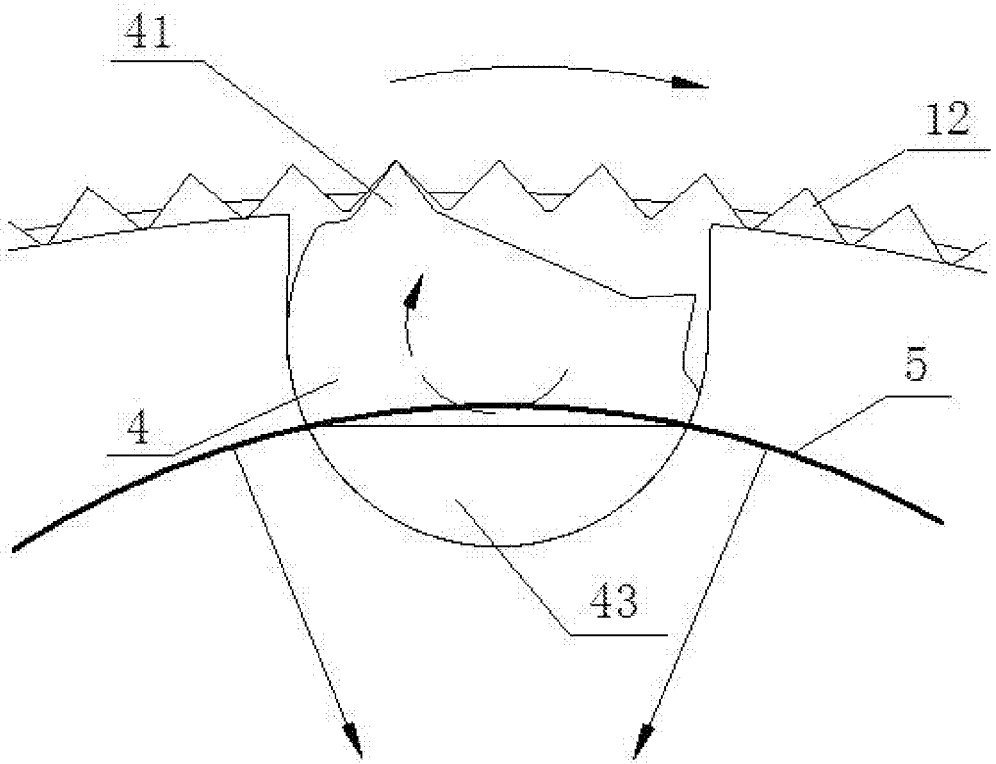
FIGS. 12 and 13 are schematic views of the engagement principle of the pins and driving apertures in Embodiment 2.

The principle of engagement of the ratchet teeth 12 with the relief 41 (i.e. snap teeth, the same below) is similar to that in Embodiment 1, as shown below:

As illustrated in FIG. 12, the spring ring 5 contracts under the spring force, the spring ring 5 applies to the bearing face 44 of the pin 4 the elastic force which tends towards the center of the spring ring 5 (i.e. the central axis of the driving aperture 1) pushes the pin 4 to rotate clockwise (as shown in the dotted arrow in FIG. 7) so as to make the relief 41 of the pin 4 stand out of the pin recess 32 and mesh with the ratchet teeth 12; therefore, when the handle 2 rotates clockwise (as shown in the dotted arrow in FIG. 7), the drive member 3 can rotate synchronously with the driving aperture 1 and the handle 2 in a clockwise direction with the engagement of the ratchet teeth 12 and the relief 41.

Figure 13:
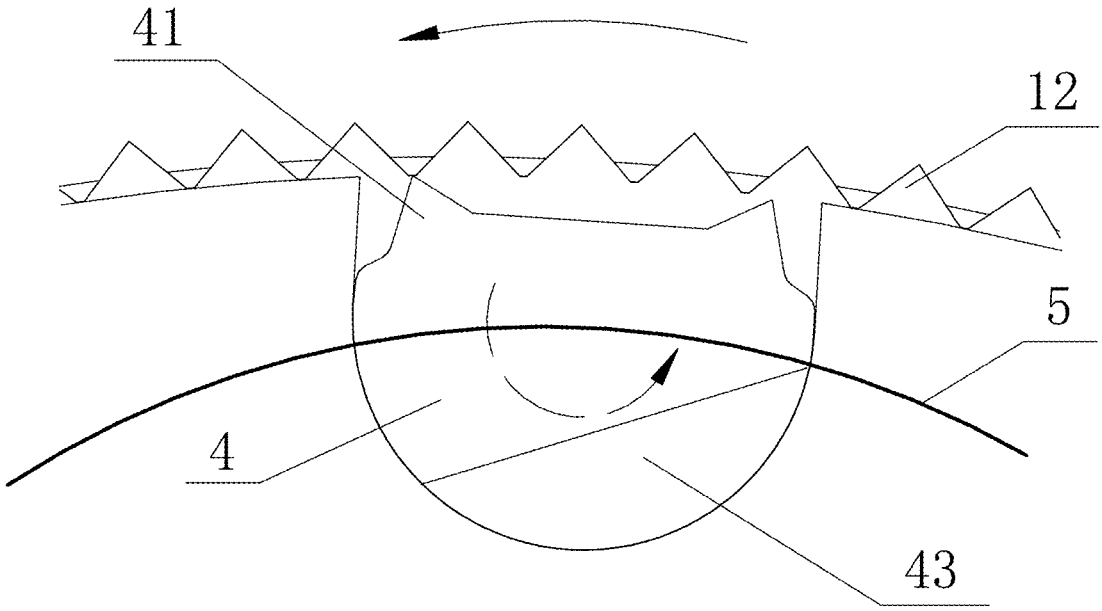

As illustrated in FIG. 13, when the handle 2 of the wrench rotates in the opposite direction (i.e. it rotates anticlockwise) (as shown in the solid arrow in FIG. 7), the counteracting force of the ratchet teeth 12 will push the pin 4 to rotate in the opposite direction (as shown in the dotted arrow in FIG. 8) to rotate the relief 41 synchronously with it in a clockwise direction, so that the spring ring 5 expands and gathers the elastic potential energy under the force applied by the pin 4, the area of contact between the relief 41 of the pin 4 and the ratchet teeth 12 is gradually reduced and finally the relief 41 contracts back to the pin recess 32 and slides over the back of the ratchet teeth 12 to avoid the drive member 3 and the fasteners engaged with the drive member 3 (e.g. nuts) from rotating anticlockwise with the driving aperture 1 and the handle 2. After the relief 41 slides over the back of the ratchet teeth 12, the relief 41 and the next ratchet tooth 12 can mesh again due to a lack of the supporting of the ratchet tooth 12 and the clockwise rotation of the pin 4 under the elastic force of the spring ring 5.

The mode of engagement of the ratchet teeth 12 with the relief 41 is adopted to lower the requirements for machining accuracy of the fit clearance between the relief 41 and the inner hole wall 11 of the driving aperture 1 and avoid the possible problem in Embodiment 1 that the reliefs 41 of some pins 4 fail to tightly press against the inner hole wall 11 of the driving aperture 1 due to insufficient accuracy of machining and further causing unevenly distributed stress between the drive member 3 and the driving aperture 1.

It is understood that the relief 41 can also be arranged at another ridge of the pin 4 and the direction of tilt of the ratchet teeth 12 can be changed so as to change the direction of rotation of the drive member 3 in the driving aperture 1, and the engagement principle of the relief 41 with the ratchet teeth 12 and the spring ring 5 is the same as that described above, so it will not be repeated.

Typically, the conventional ratchet wrench is provided with the mode of single-tooth or double-teeth meshing, and due to the limit on the strength of a single ratchet tooth, it is difficult to enhance the upper limit of torque transfer, and all pin teeth in this embodiment can mesh with the ratchet teeth 12, so that the torque can be evenly distributed on all pin teeth and the manufacturer may increase the quantity of pins 4 as needed, and in this embodiment, a plurality of pins 4 are evenly distributed on the external side face of the whole drive member 3 at regular intervals, so compared with the conventional ratchet wrench having the single-tooth or double-teeth meshing mode, a single ratchet tooth 12 or a pin tooth in this embodiment withstands less loads to lower the requirements for the material strength of the driving aperture 1, the ratchet teeth 12 and the pin teeth. And because the pin 4 and the ratchet tooth 11 are disposed on the drive face, its length can be close to the width of the drive face, and after the pin 4 and the ratchet tooth 12 mesh, the whole side face of the pin teeth can contact the whole side face of the ratchet teeth 12; therefore, the area of contract becomes larger and the requirements for the material strength of the driving aperture 1, the ratchet teeth 12 and the pin teeth are further lowered.

Embodiment 3

Figure 14:
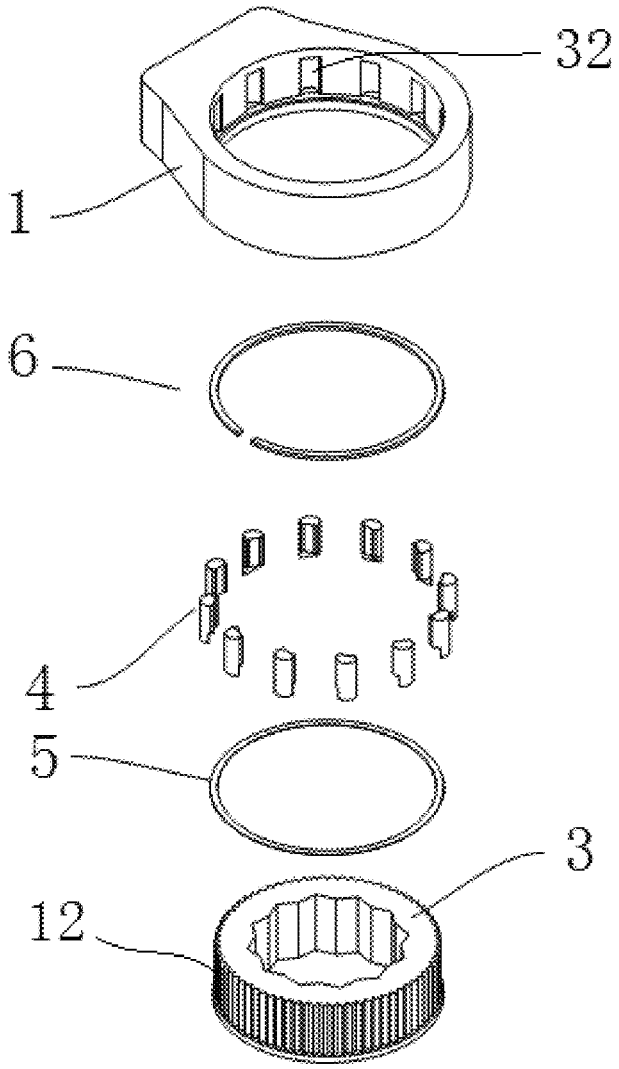
FIG. 14 is a schematic view of breakdown structure of the wrench in Embodiment 3.
Figure 15:
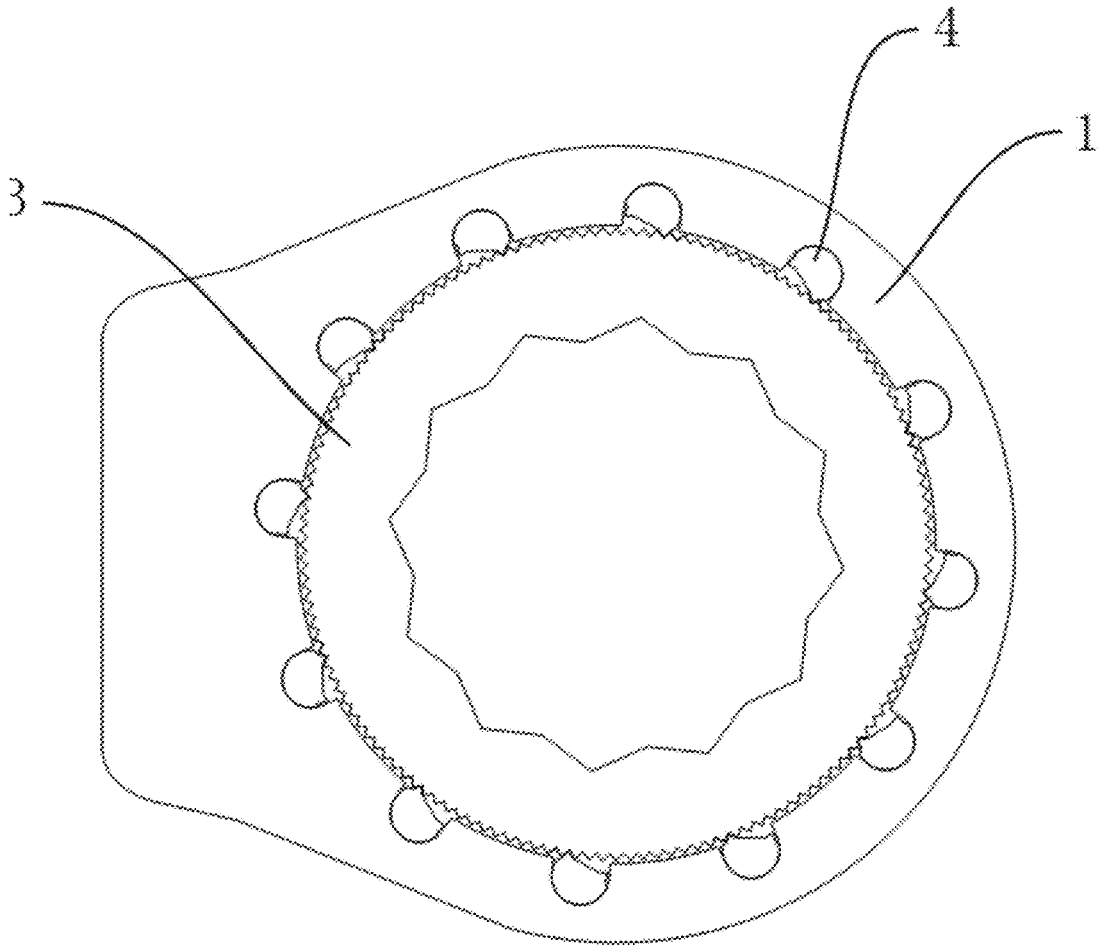
FIG. 15 is a schematic view of the engagement of the drive members, pins and driving apertures in Embodiment 3.
Figure 16:
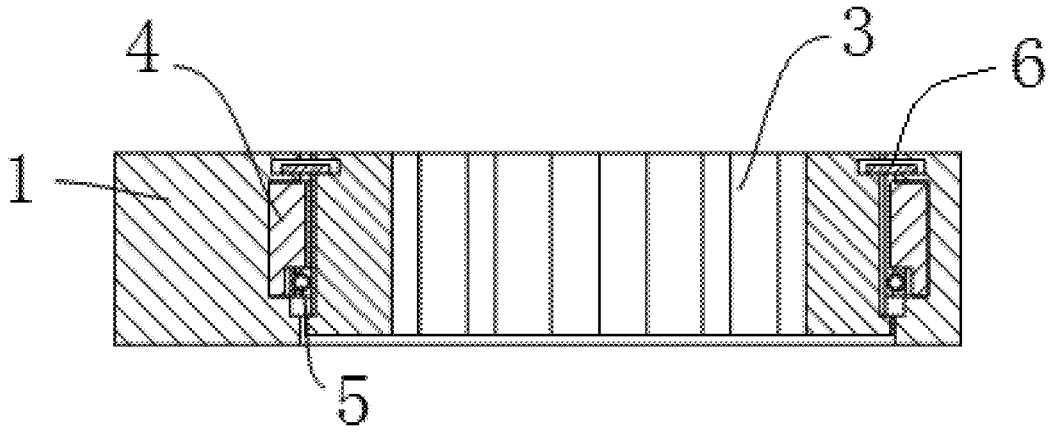
FIG. 16 is a schematic view (sectional view) of the engagement of the drive members, pins, driving apertures and spring rings in Embodiment 3.

As illustrated in FIGS. 14, 15 and 16, the difference from Embodiment 2 is that the inner hole wall 11 of the driving aperture 1 is used as the first drive face having the pin recess 32 and the external side face of the drive member 3 is used as the second drive face having the ratchet teeth 12 in this embodiment, and for other structures and operating principles of this embodiment, refer to Embodiment 2, so they will not be repeated herein.

It is understood that the spring ring 5 in Embodiments 1, 2 and 3 described above can also be arranged in a circle surrounded by all pins 4, and the spring ring 5 is pressed against the bearing face 44 of the spring pressing portion 43 of all pins 4 at the same time, and the elastic force that is produced by outward expansion of the spring ring 5 is employed to reset the pins 4.

Figure 17:
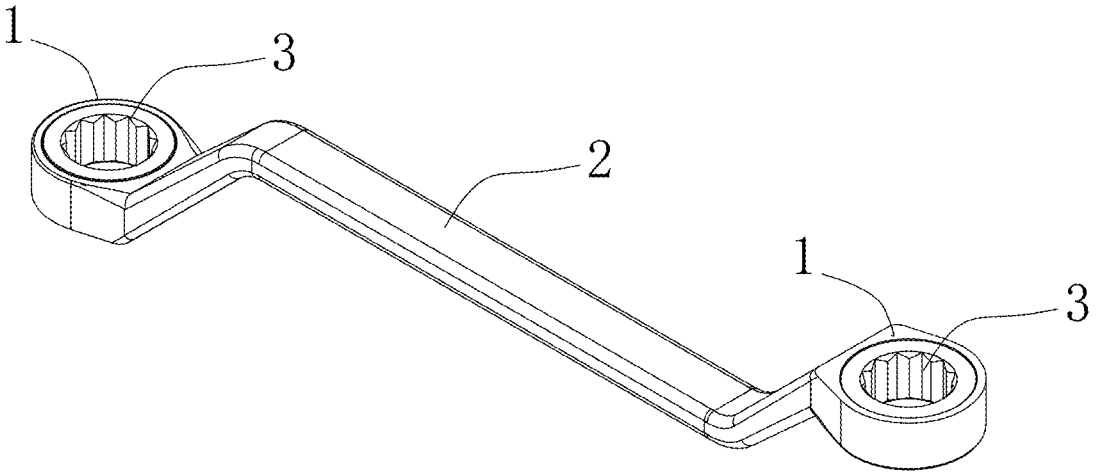
FIGS. 17 and 18 are schematic views of the structures of two types of wrenches.
Figure 18:
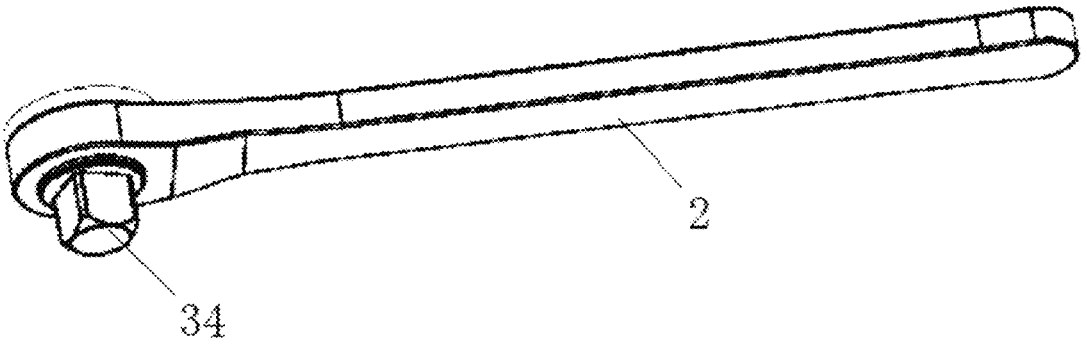

In addition, FIGS. 17 and 18 illustrate the wrenches having two different structures, wherein:

in the wrench as shown in FIG. 17, both ends of the handle 2 are separately provided with a driving aperture 1 and the direction of rotation of the drive member 3 in the driving aperture 1 on one end is opposite to that on the other end, and when a fastener is to be turned in the opposite direction, the wrench is turned only and the drive member 3 in the other driving aperture 1 is used to be engaged with the fastener to realize the reverse torque transfer.

In the wrench as shown in FIG. 18, the center of the drive member 3 is provided with a cylinder 34 in the shape of a regular polyhedron, rather than a quincuncial through hole, and this cylinder 34 can stand out of the wrench surface and then be inserted and embedded in the sleeve to realize the engagement with a fastener via the sleeve.

INDUSTRIAL APPLICABILITY

The high-torque ratchet wrench in the present invention has a significant influence on the fields of tightening and disassembly tools. Compared with the background art, the wrench in the present invention has a unique structure of torque transfer to greatly enhance the capability of torque transfer and simultaneously provide the whole wrench with a simple and compact structure, having very good utility.

The invention claimed is:

1. A high-torque ratchet wrench comprising:

a wrench body having a driving aperture (1) with a rounded through hole and a handle;

a drive member (3) (*a*) disposed in the driving aperture (1) and (b) comprising an external side wall provided with a plurality of pin recesses (32) equally distributed along the external side wall of the drive member (3);

an axial position-limiting mechanism disposed between the driving aperture and the drive member to prevent the drive member (3) from axially moving from the driving aperture (1) and further being released from the driving aperture (1), wherein the axial position-limiting mechanism is realized by adopting a snap spring (6) mounted in a snap spring recess (7); and a plurality of pins (4) each comprising (a) a relief (41) disposed on a side face of each of the plurality of pins (4), wherein the relief (41) has a direction of extension parallel to an axial direction of the driving aperture (1);

(b) an arc surface (42) in a side and back of each of the pins (4) toward the relief (41), wherein the arc surface (42) fits an arc structure of the one pin recess (32) to reduce resistance encountered by each of the plurality of pins (4) during a process of rotation and to limit a rotation of each of the plurality of pins (4);

(c) a stepped spring pressing portion (43) disposed at and projecting from an end of each of the plurality of pins (4) and (d) a flat bearing face (44) in plane parallel to an axial direction of each of the plurality of pins (4);

wherein the external side wall of the drive member (3) and an internal aperture side of the driving aperture (1) form a first cylindrical drive face and a second cylindrical drive surface nested, each of the plurality of pins (4) is rotatably mounted in one of the plurality of pin recesses (32), each of the plurality of pins (4) is connected with a resilient reset member, each of the plurality of pins (4) is rotated with the resilience of the resilient reset member, the relief (4) is driven to stand out of the one of pin recesses (32) and contacts the second cylindrical drive face, and a distance between an outermost end point of the relief (41) and a central axis of each of the plurality of pins (4) is greater than a minimum distance between the second cylindrical drive face and the central axis of each of the plurality of pins (4), and the resilient reset member is a spring ring (5) that is arranged outside a circle surrounded by each of the plurality of pins (4), and the spring ring (5) is covered on the bearing face (44) of the spring pressing portion (43) of each of the plurality of pins (4) at the same time; the spring ring (5) contracts under the spring force, the spring ring j applies to the bearing face (44) of each of the plurality of pins (4) an elastic force which tends towards the central axis of the driving aperture (1), and under the decomposition of the bearing face (44), part of the elastic force is transformed to the force used for rotating each of the plurality of pins (4) clockwise so as to make the relief (41) of each of the plurality of pins (4) stand out of the one pin recess (32) gradually and contact the inner hole wall (11) of the driving aperture (1); namely, the diameter of an element formed by the drive member (3) and the pins (4) is gradually increased to expand and finally the external side face of this element is pressed against the inner hole wall (11) of the driving aperture (1);

the external side face of the drive member (3) is provided with a fixed recess (33) used for limiting the axial movement of the spring ring (5), wherein the fixed recess (33) is intersected with the one pin recess (32) and the spring ring (5) is clamped in the fixed recess (33) to avoid axial movement;

when the handle (2) rotates in a clockwise direction, a force of friction between an inner hole wall (11) of the driving aperture (1) and the relief (41) pushes the relief (41) in the clockwise direction, so that the pressure between the relief (41) of the pin (4) and the inner hole wall (11) of the driving aperture (1) is gradually increased and the force of friction presses the pin 4 against a side wall of the pin recess (32), and the pin (4) and the drive member (3) form a relatively stable structure under the pressure; the force of friction and the pressure push the drive member (3) to rotate by using the pin (4) to realize a torque transfer between the handle (2) via the driving aperture (1) and the drive member (3) and the fastener is engaged with the drive member (3); and when the handle (2) rotates in an anticlockwise direction, the force of friction between the inner hole wall (11) of the driving aperture (1) and the relief (41) drives the pin (4) to overcome an elastic force of the spring ring (5) and to rotate synchronously with the inner hole wall (11) of the driving aperture (1) in the anticlockwise direction, so that the spring ring (5) expands and gathers elastic potential energy under the force applied by the pin (4); due to the anticlockwise rotation of the pin (4), the relief (41) gradually moves in the direction of the pin recess (32) to increasingly reduce the pressure between the relief (41) and the inner hole wall (11) of the driving aperture (1) and also increasingly decrease the force of friction between the relief (1) and the inner hole wall (11) of the driving aperture (1), and finally, the relief (41) slides over the inner hole wall (11) of the driving aperture (1), so that the drive member (3) and the fastener engaged with the drive member (3) will not rotate synchronously with the handle (2) in the anticlockwise direction; and the handle (2) completes a disassembly of the fastener.

2. The high-torque ratchet wrench as claimed in claim 1, wherein the spring ring is covered on or pressed against the spring pressing portion, the spring ring is placed eccentrically from the central axis of the pin by using the force applied on the pin by a spring pressing portion, so that the pin rotates under a spring force of the resilient reset member.

3. The high-torque ratchet wrench as claimed in claim 2, wherein the fixed recess is disposed on the first cylindrical drive face and the second cylindrical drive face or the spring pressing portion to limit the axial movement of the spring ring.

4. The high-torque ratchet wrench as claimed in claim 3, wherein the pin side having the back toward the relief is an arc surface and the pin recess is provided with an arc structure adapting to the arc surface.

5. The high-torque ratchet wrench as claimed in claim 1, wherein ratchet teeth are evenly distributed on the second drive face, the direction of extension of the ratchet teeth is parallel to a central axis of the driving aperture, and the relief is pin teeth mated to the ratchet teeth.

6. The high-torque ratchet wrench as claimed in claim 5, wherein the two drive faces are provided with the snap spring recess at a corresponding location, and the snap spring is mounted in the snap spring recess.

7. The high-torque ratchet wrench as claimed in claim 6, further comprising a second driving aperture coupled with a second drive member, wherein the driving aperture is arranged on a first end of the handle, the second driving aperture is arranged on a second end of the handle opposite the first end, a mounting direction of each of the driving aperture and the second driving aperture is opposite to that of the drive member and the second drive member, respectively.

8. The high-torque ratchet wrench as claimed in claim 6, wherein a quincuncial through hole or a cylinder in the shape of a regular polyhedron standing out of a wrench surface is arranged in the center of the drive member.

9. The high-torque ratchet wrench as claimed in claim 6, wherein the resilient reset member is a ring-shaped spring.

* * * * *